United States Patent [19]

Reinhard

[11] 4,189,028

[45] Feb. 19, 1980

[54] FOLDING FIRE ESCAPE LADDER

[76] Inventor: Cheyenne A. Reinhard, 29372 Providence Way, Hayward, Calif. 94544

[21] Appl. No.: 963,024

[22] Filed: Nov. 22, 1978

[51] Int. Cl.[2] ..... E06C 9/12

[52] U.S. Cl. ..... 182/160; 182/96

[58] Field of Search ..... 182/159, 160, 95, 96, 182/161

[56] References Cited

U.S. PATENT DOCUMENTS

| | | | |
|---|---|---|---|
| 256,990 | 4/1882 | Fish | 182/160 |
| 278,301 | 5/1883 | Welsh | 182/96 |
| 704,126 | 7/1902 | Seessle | 182/160 |
| 3,575,263 | 4/1971 | Reinhard | 182/160 |
| 3,756,347 | 9/1973 | Messera | 182/160 |

*Primary Examiner*—Reinaldo P. Machado
*Attorney, Agent, or Firm*—Lothrop & West

[57] ABSTRACT

A folding fire escape ladder has a first upright, L-shaped in transverse cross-section, as well as a second upright, similarly shaped. The uprights are joined for movement into and out of nested position by parallel, cross rungs of flat material journalled at their opposite ends on pins projecting from the uprights. Stops on at least one upright engage and limit the movement of the rungs. A latch lever has a notch corner adapted to engage one of the uprights when the latch lever is hooked onto the other upright. A spring urges the latch lever into such engagement except when the notch corner cams the latch lever out of engaging position. A hood on the latch lever normally overlies the upper ends of the uprights. Each rung has elongated grooves in its opposite sides occupied by facing beads on treads of inverted U-shape in cross-section. A crank lever is journalled in one of the uprights and when rotated presses a cam on the lever against the other upright to spread the uprights apart.

4 Claims, 12 Drawing Figures

FOLDING FIRE ESCAPE LADDER

BRIEF SUMMARY OF THE INVENTION

A folding fire escape ladder has two uprights fastened together for parallel motion by a plurality of substantially parallel rungs movable against stops. There is a latch lever fulcrumed on one of the uprights by a notch having a cam corner and joined by a hook to the other upright. When the lever is rotated, the cam corner pivots the lever so that the hook is moved out of engaging position. There is a hood on the lever which normally overlies the nested uprights. The rungs have lateral grooves in their opposite sides into which engage beads on rung treads. One of the uprights also serves as a mounting for a crank journalled therein. When rotated, the crank impels a cam fastened thereon to abut the adjacent upright in order to spread the uprights apart.

DETAILED DESCRIPTION

Figure 1:
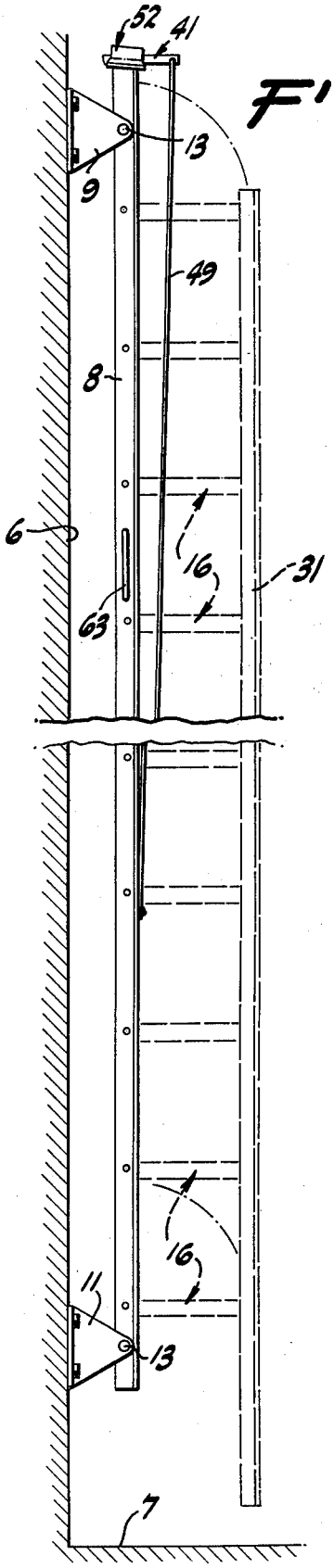
FIG. 1 is a side elevation of a folding fire escape ladder constructed pursuant to the invention and shown in both inactive and active positions.
Figure 2:
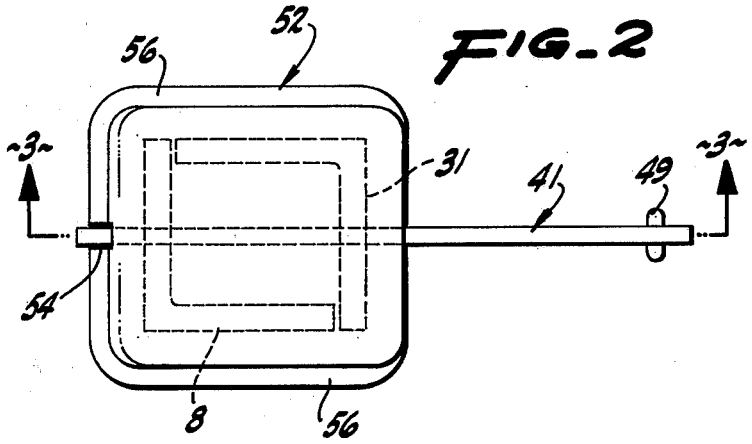
FIG. 2 is a plan of the structure of FIG. 1 in inactive position.

The folding fire escape ladder herein is an improvement upon and a development from the folding fire escape ladder disclosed in the present applicant's earlier U.S. Pat. No. 3,575,263 issued Apr. 20, 1971. In the development and extensive commercial use of such earlier device, the possibilities for improvements have presented themselves, and such improvements are the primary subject matter of this case.

The ladder itself is primarily for use in connection with the wall 6 of a building resting upon the ground 7. The ladder includes a first upright 8, preferably a metal member that is L-shaped in plan or cross-section and that is extensive enough to rise approximately two stories near the side of the building 6. The first upright 8 is secured in position by brackets 9 and 11 fastened to the building 6 and having fasteners 13 interengaging the brackets and the first upright.

Spaced along the length or height of the first upright at appropriate intervals are pins 14 for pivotally interengaging the first upright with each of a plurality of rungs 16. Each pin is preferably provided with a shoulder 17 adapted to abut the flange of the upright when a head 18 of the pin is riveted over. The pin likewise includes an end flange 19 defining the length of a journal 21 between the upright flange and the flange 19 so as to afford a bearing or pivot support for one perforated end of an associated rung 16.

Each rung 16, in turn, is fabricated of a relatively flat strap having its intermediate portion offset from its ends so that while the ends 23 and 24 are parallel to each other the intermediate portion is disposed at a slight angle. Each of the ends of the rung at the parallel portion has an aperture 26 therethrough.

To limit the journal or pivot movement between the rungs and the upright there are stop pins 27 projecting from the first upright and of the same general construction as the pins 14, so that the flanges 19 thereon serve as limits to axial movement of the rungs.

The rungs are all kept in parallel relationship by being fastened at their opposite ends to another or second upright 31 having mirror symmetry with the first upright 8 and being of substantially the same length. Similar pins 32 journal the outer ends of the rungs to the second upright, and similar stop pins 33 act to limit the relative rotation between the second upright and the various rungs.

To make sure that these parts can always rotate relative to each other with considerable freedom and without sticking, despite relatively high or low temperatures, the ends of the rungs, particularly the portions near the adjacent L-shaped members, are treated with a coating 34 of a dry lubricant such as a suitable fluorocarbon material.

The dimensions of the structures as so far described are such that when the ladder is folded, as shown particularly in full lines in FIG. 1, the second upright 31 virtually nests with the first upright 8 and houses the several rungs 16 therebetween, making a quite compact, protected package. But when the second upright is moved outwardly away from the first upright by rotation of the rungs about their various pins, the uprights are far enough apart to afford rungs of adequate dimension to support the weight and bulk of an adult. The stops 33 and 27 are so positioned that the rungs occupy substantially horizontal positions when the uprights are spaced apart and loads are transmitted or distributed throughout the ladder.

Normally, the ladder is closed and kept in its most compact position. To hold it so, yet to permit it to be appropriately released, there is provided, as shown particularly in FIGS. 2, 3, 4 and 10, 11 and 12, a special latching arrangement. A latch lever 41 is primarily a metal strap at one end formed to provide a latch hook 42 readily engageable over the upper end of the first upright 8. The lever also has a specially formed indentation 43 or notch of a relatively small compass to define a notch corner 44. This corner barely bears against the outer surface of the second upright 31 when the parts are in the position shown in FIG. 3. A spring 46 at one end is fastened to the upright 31 and at the other end is hooked into an aperture 47 through the lever 41. The outer end of the lever has a further aperture 48 to receive a lanyard 49 extending from the lever to a convenient point of attachment 51, usually near the center of the first upright 8.

Since the ladder is normally in its stowed or nested condition, and in order to preclude entry of snow, water and the like to the nested parts, the lever 41 is used as a support for a cap 52 conveniently of plastic material having walls 53 with notches 54 therein adapted to be tightly pressed onto the lever 41. Conveniently, the cap has an outturned flange or skirt 56 around its lower perimeter.

When the first and second uprights are to be separated to permit operation of the ladder, the lanyard 49 is pulled downwardly. This rocks the lever 41 (FIGS. 10 and 11) so as to lift the notch 42 or hook above and away from the end of the upright 8. Such motion is against the urgency of the spring 46 and, because of the cam corner 44, is effective not only to lift the notch 43 above the end of the second upright 31, but also is effective to displace the lever 41 endwise, as particularly shown in FIGS. 11 and 12. When the lever is displaced, the hook 42 is pulled laterally out of registry with the upper end of the first upright 8. The effect is immediately to release the two upright members from each other, but also to preclude any inadvertent or casual rehooking of the upright members. Once released, therefore, the hook must be specially manipulated for reengagement. Once released, the ladder extends to its use position and, although readily restored to its stowed position, is not readily rehooked without local end movement of the latch lever 41.

Operation of the lever 41 also lifts the cap 52 out of the way and permits the weight of the parts generally to bring them into the dotted line position shown in FIG. 1 for use.

Figure 8:
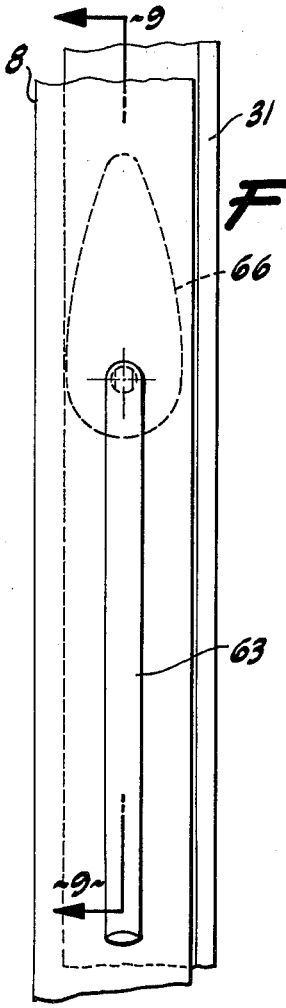
FIG. 8 is a detail view, portions being broken away, of the fire escape ladder in inactive position and with the cam and lever mechanism in inactive position.
Figure 9:
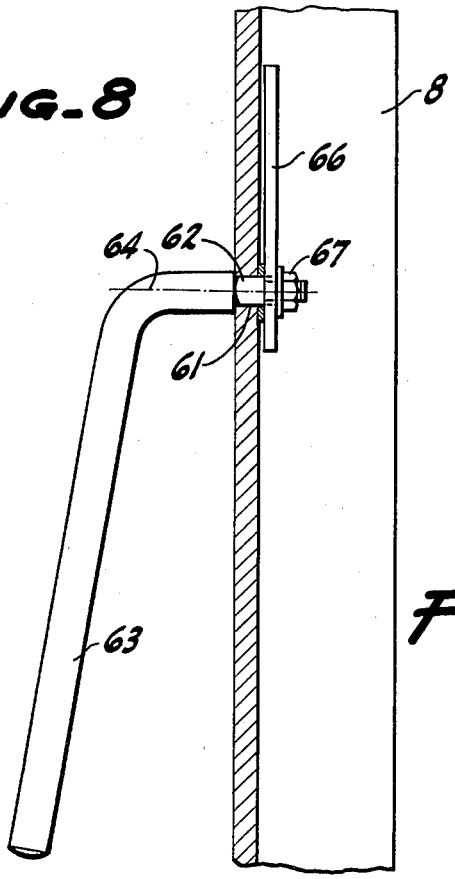
FIG. 9 is a cross-section, the plane of which is indicated by the line 9—9 of FIG. 8.

Under some circumstances, it may be that there is sufficient resistance to motion of the movable parts to preclude ready initial opening of the ladder. For that reason, as especially shown in FIGS. 8 and 9, the first upright 8 in a convenient location, preferably near an upper portion of the structure, has an opening 61 therein serving as a bearing for a journal 62 forming part of a crank lever 63 and so rotatable about an axis 64. The member 62 has a non-circular interengagement with an elongated cam 66 held in position by a nut 67 threaded onto the end of the journal 62. In the event the movable members do not move freely and readily, a person then rotates the lever 63 about the axis 64 and brings the cam 66 into abutment with the opposite flange on the second upright 31 and pries that upright away from the first upright 8 a sufficient distance so that the remainder of the motion can readily be accomplished or forced. Preferably the weight of the lever handle 63 is such that it normally returns to its vertical position, as shown in FIG. 8, thus retracting the cam and permitting renesting of the ladder uprights.

Figure 5:
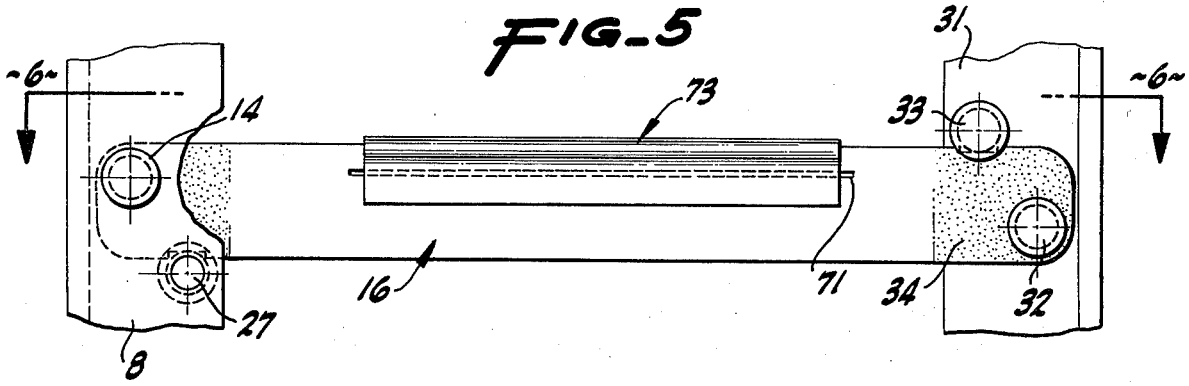
FIG. 5 is a detailed view in side elevation showing a portion of the fire escape ladder in active position with some portions being broken away.
Figure 6:
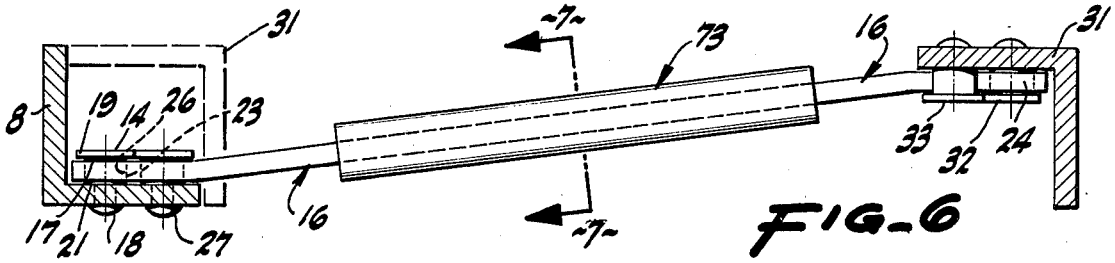
FIG. 6 is a cross-section, the plane of which is indicated by the line 6—6 of FIG. 5.
Figure 7:
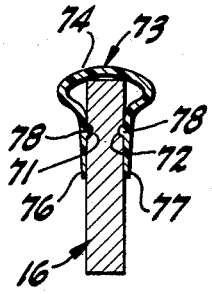
FIG. 7 is a cross-section, the plane of which is indicated by the line 7—7 of FIG. 6.

While flat strip material is quite satisfactory in general for the various ladder rungs, it has been found that use is facilitated by providing somewhat broader bearing for the user's feet. For that reason, each of the rungs 16 is formed with grooves 71 and 72 (see FIGS. 5 and 7) on its opposite sides, the groove terminating well before the ends of the rungs.

Designed to snap over the top of each rung is a tread 73 of substantially an inverted U-shaped cross-section having a broad top portion 74 and relatively closely spaced, depending flanges 76 and 77. Each of the flanges on its innermost face is provided with an extruded bead 78 adapted to snap into the grooves 71 and 72. With this arrangement, the relatively broad rounded upper surface 74 is effective to distribute the load of the user's weight over an increased area, thus reducing the discomfort of the rung. The treads 73 are kept in position because of the interengagement of the beads 78 and the grooves 71. The endwise displacement of the beads is also precluded because of the short length of the grooves 71, so that when the rungs are in nearly vertical position when the ladder is stowed, nevertheless the rungs are kept against endwise displacement, by gravity or other forces, and are always in proper position for immediate and appropriate use.

With this arrangement, the stowed ladder is immediately released by pulling the lanyard 49 and if necessary by operating the crank 63. When the ladder is in open or lowered position, the rungs are readily available in their substantially horizontal position, and the treads upon them make the use of the ladder facile even for relatively heavy or barefoot users.

Figure 3:
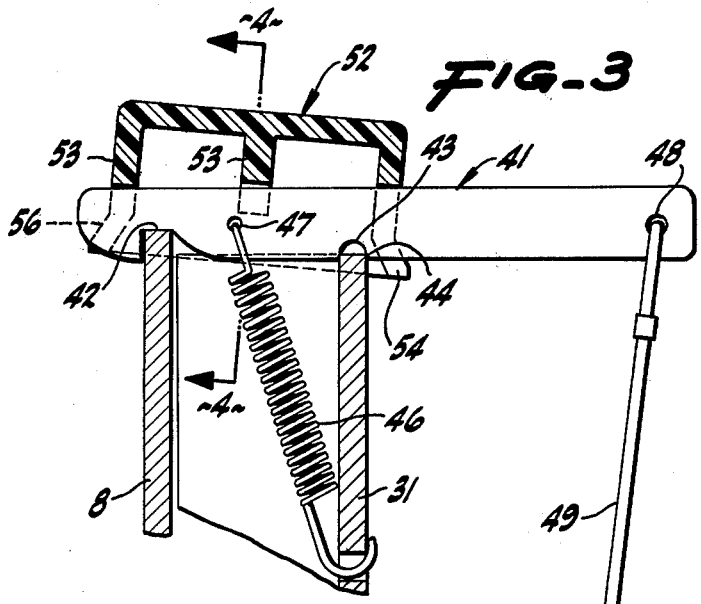
FIG. 3 is a detail cross-section, the plane of which is indicated by the line 3—3 of FIG. 2.
Figure 4:
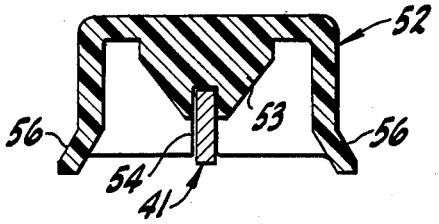
FIG. 4 is a cross-section, the plane of which is indicated by the line 4—4 of FIG. 3.
Figure 10:
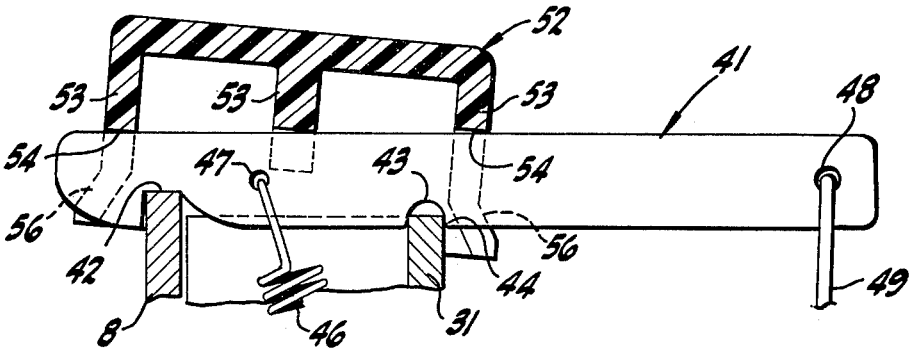
FIGS. 10, 11 and 12 are detailed views, similar to FIG. 3 but showing the cap and latch lever mechanism in successive positions of operation.
Figure 11:
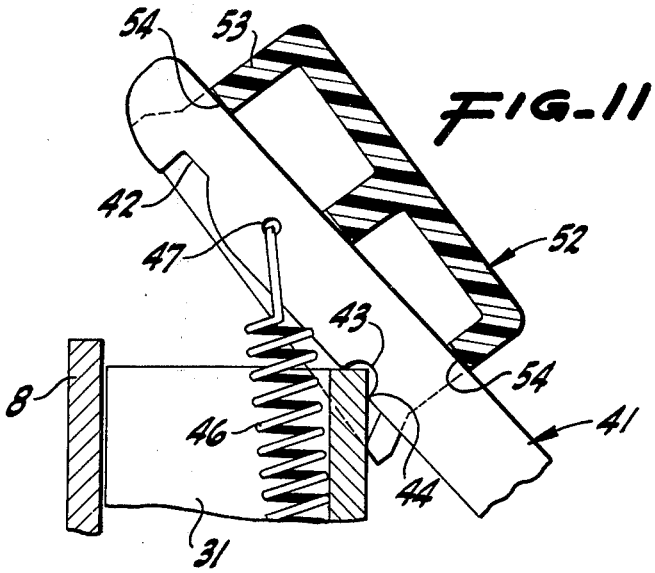
Figure 12:
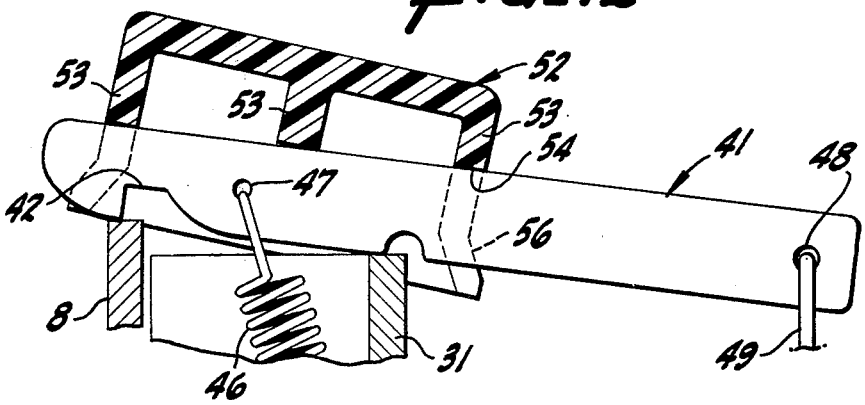

Since the notch lever 41 is slightly displaced or cammed out of position when the lanyard 49 is first pulled, it is not possible to refasten the ladder or to restore it to its nested position inadvertently. The entire ladder must be carefully inspected and returned to its nested position and the lever 41 must be translated endwise substantially into its position as shown in FIGS. 3 and 10 before the hook can be reengaged. When the hook is reengaged, the parts are restored to their ready condition, the interior of the structure being well protected by the repositioning of the cap 52 with the reengagement of the latch lever.

I claim:

1. A folding fire-escape ladder comprising a first upright L-shaped in transverse cross-section, a second upright L-shaped in transverse cross-section, a plurality of cross rungs of flat material and offset at their opposite ends, pins for pivotally interengaging the respective offset ends of said rungs with said first upright and said second upright respectively, stops on at least one of said uprights for limiting pivotal movement between said rungs and said first and second uprights, a latch lever, means in said latch lever defining a notch corner adapted to cam against the faces of said second upright when said latch lever is in engagement with said first upright, a spring engaging said first upright and said latch lever, and a cap mounted on said latch lever and adapted to overlie the upper ends of said first and second uprights when said latch lever is in engagement therewith.

2. A device as in claim 1 in which said cross rungs of flat material have elongated grooves on opposite sides thereof, treads of substantially U-shaped cross-section adapted to fit over said cross rungs, and beads on the facing surfaces of said treads adapted to interfit in said elongated grooves.

3. A device as in claim 2 in which said grooves stop short of the ends of said rungs and said beads stop short substantially at the ends of said grooves.

4. A device as in claim 1 including a crank lever journalled in said first upright to rotate about a transverse axis, and a cam fast on said crank lever for rotation about said axis, said cam being shaped in one position to lie entirely within the confines of said first upright and in another position to abut against said second upright.

* * * * *